US011103838B2

(12) United States Patent
Kato

(10) Patent No.: US 11,103,838 B2
(45) Date of Patent: Aug. 31, 2021

(54) JET INJECTION DEVICE

(71) Applicant: LEFRAN CO., LTD., Akita (JP)

(72) Inventor: Jiro Kato, Akita (JP)

(73) Assignee: LEFRAN CO., LTD., Akita (JP)

( * ) Notice: Subject to any disclaimer, the term of this patent is extended or adjusted under 35 U.S.C. 154(b) by 176 days.

(21) Appl. No.: 16/341,719

(22) PCT Filed: Apr. 20, 2018

(86) PCT No.: PCT/JP2018/016378
§ 371 (c)(1),
(2) Date: Apr. 12, 2019

(87) PCT Pub. No.: WO2018/198994
PCT Pub. Date: Nov. 1, 2018

(65) Prior Publication Data

US 2020/0179882 A1 Jun. 11, 2020

(30) Foreign Application Priority Data

Apr. 24, 2017 (JP) ..... JP2017-085258

(51) Int. Cl.
*B01F 3/04* (2006.01)
*B01F 5/02* (2006.01)
(Continued)

(52) U.S. Cl.
CPC ..... *B01F 3/04446* (2013.01); *B01F 5/02* (2013.01); *B01F 5/12* (2013.01); *B01F 5/20* (2013.01);
(Continued)

(58) Field of Classification Search
CPC ..... B01F 3/04446; B01F 5/02; B01F 5/12; B01F 5/20; B01F 2003/04858; B01F 2215/0052
(Continued)

(56) References Cited

U.S. PATENT DOCUMENTS 4,211,733 A * 7/1980 Chang ..... B01F 5/0206 261/36.1
4,379,097 A * 4/1983 Leggett ..... B01F 5/0403 239/428.5
(Continued)

FOREIGN PATENT DOCUMENTS

JP 52-152410 U 11/1977
JP 09-206637 A 8/1997
(Continued)

OTHER PUBLICATIONS

Search Report issued in International Bureau of WIPO Patent Application No. PCT/JP2018/016378, dated May 22, 2018.

*Primary Examiner* — Charles S Bushey
(74) *Attorney, Agent, or Firm* — Greenblum & Bernstein P.L.C.

(57) ABSTRACT

A jet injection device that incorporates nanobubbles (ultra-fine bubbles) in a mist includes: a two-fluid nozzle configured from a circular nozzle outer cylinder and an air connection tube integrally and perpendicularly connected to the nozzle outer cylinder; a nanobubble generation device that supplies the nozzle outer cylinder of the two-fluid nozzle with high-pressure nanobubble water; and a compressor that supplies the air connection tube of the two-fluid nozzle with high-pressure air. The gas-injected bubble water generated from the nanobubble generation device is pressure-fed to the nozzle outer cylinder of the two-fluid nozzle, and compressed air from the compressor is pressure-fed to the air connection tube of the two-fluid nozzle. In the two-fluid nozzle, the high-pressure gas-injected bubble water and the compressed air serve as a gas-liquid fluid mixture, and are injected at a high speed in mist form from a nozzle cylinder of the two-fluid nozzle.

3 Claims, 6 Drawing Sheets

(51) Int. Cl.
*B01F 5/12* (2006.01)
*B01F 5/20* (2006.01)

(52) U.S. Cl.
CPC ..... *B01F 2003/04858* (2013.01); *B01F 2215/0052* (2013.01)

(58) Field of Classification Search
USPC ..... 261/76, DIG. 75
See application file for complete search history.

(56) References Cited

U.S. PATENT DOCUMENTS

| | | | | |
|---|---|---|---|---|
| 8,302,942 | B2 * | 11/2012 | Tsai | B01F 3/0446 261/77 |
| 2002/0113327 | A1 * | 8/2002 | Hara | B05B 7/0475 261/76 |
| 2008/0048348 | A1 * | 2/2008 | Kung | A01K 63/042 261/76 |
| 2009/0223016 | A1 | 9/2009 | Iijima et al. | |
| 2015/0273408 | A1 * | 10/2015 | Tachibana | B01F 15/00538 366/162.4 |
| 2019/0298653 | A1 * | 10/2019 | Yamanouchi | A61K 33/00 |

FOREIGN PATENT DOCUMENTS

| | | | |
|---|---|---|---|
| JP | 2009-226392 | A | 10/2009 |
| JP | 2013-184152 | A | 9/2013 |
| JP | 2014-181999 | A | 9/2014 |
| JP | 2016-112477 | A | 6/2016 |
| WO | 95/27557 | A1 | 10/1995 |

* cited by examiner

JET INJECTION DEVICE

TECHNICAL FIELD

The present disclosure relates to a jet injection device for injecting mist at a high speed by incorporating nanobubbles (ultrafine bubbles) in the mist.

BACKGROUND ART

It can be seen that micro bubbles (fine bubbles) are much smaller bubbles than ordinary bubbles, but have various features not provided in large bubbles, in which a floating speed thereof in water is extremely low, they are easily spread in water and are adsorbed to substances in water, as well as the bubbles are more resistant to bursting and the like. Therefore, there are application examples of the microbubbles across various fields such as a wastewater treatment field, washing field, beauty field, aquaculture field and the like.

Ultrafine bubbles smaller than the microbubbles are referred to as nanobubbles.

A gas-liquid mixing T-joint, in which high-pressure liquid is mixed with high-pressure air to form a jet stream, and the high-speed and high-pressure mixed fluid is sprayed from a tip nozzle, has been known in the art (see Japanese Patent Laid-open Publication No. 2013-184152).

In this Japanese Patent Laid-open Publication No. 2013-184152, high-pressure liquid such as water is supplied from an upstream side of a joint body 5, and high-pressure air including abrasive agents such as metal particles and sand particles is supplied from high-pressure air pipe 12, and then the high-pressure liquid and air are mixed at a position of an inside piece 8. The mixed fluid is merged into high-pressure fluid on a downstream side at an angle of 40 to 50° by an inclined cut opening 7 of the inside piece 8, thus to bring into high-speed and high-pressure gas-liquid mixed fluid to be pumped.

Therefore, the gas-liquid mixed fluid may collide with dirt and paint etc. attached to an object to be polished as a high-speed jet stream, thereby scrubbing off the dirt and paint from the object.

In addition, a microbubble generator, which includes a pump, a two-fluid nozzle, two valves, a porous filter and tubes while having the extremely reduced number of used components, has been known in the art (see Japanese Patent Laid-open Publication No. 2016-112477).

In this Japanese Patent Laid-open Publication No. 2016-112477, a two-fluid nozzle 11 for mixing gases from a gas generator 3 with return liquid from a storage tank 2 to form gas-liquid mixed fluid is configured in such a way that a nozzle beak 18 is fitted to a nozzle outer cylinder 17, and a tip of the nozzle beak 18 is located at a tapered surface of a nozzle chamber 19 formed in the nozzle outer cylinder 17, and a return liquid 1 from a circulation tube 10 strongly flows through the nozzle, such that a suction force of the gas is generated to a first valve 9. At this time, in the nozzle chamber 19, the liquid, the air and the gases are appropriately mixed with each other to form gas-liquid mixed fluid. When the gas-liquid mixed fluid pushed out from a pressurized liquid pump 12 is put into a pumping tube 13 and is returned to a steady state to be in a supersaturated state, cavitation (a phenomenon in which bubbles are formed and collapse) is strongly generated, thus to deposit the dissolved air and gases. At this time, the gas-liquid mixed fluid boils. The gas-liquid mixed fluid is guided as it is so as to have an appropriate clearance by a second valve 14 and is returned to a normal pressure, thus to bring the gases dissolved in the liquid into nanobubbles (ultrafine bubbles) to be discharged into the storage tank 2.

The respective above-described techniques known in the art relate to an apparatus for generating jet streams and micro bubbles, and are individual inventions. The present applicant has demonstrated that these techniques are related and connected to each other, and nanobubbles are incorporated in mist and are injected at a high speed, such that different effects can be exerted depending on a type of the gas incorporated in the mist.

CITATION LIST

Patent Document

[Patent Document 1] Japanese Patent Application Laid-open Publication No. 2 013-184152 (see FIG. 1)

[Patent Document 2] Japanese Patent Application Laid-open Publication No. 2016-112477

SUMMARY OF INVENTION

Technical Problem

It is an object of the present disclosure to provide a jet injection device for injecting mist at a high speed by incorporating nanobubbles (ultrafine bubbles) in the mist.

Solution to Problem

A jet injection device of the present disclosure includes: a two-fluid nozzle including a nozzle outer cylinder of a cylindrical pipe and an air connection pipe integrally connected to the nozzle outer cylinder at a right angle; a nanobubble generation device configured to supply high-pressure nanobubble water to the nozzle outer cylinder of the two-fluid nozzle on one side thereof; and a compressor configured to supply high-pressure air to the air connection pipe of the two-fluid nozzle on the other side thereof.

Advantageous Effects

According to the jet injection device of the present disclosure, since the nanobubbles can be mixed in the mist, an effect of gas, in which gases are sprayed to a destination, may be expected.

DESCRIPTION OF EMBODIMENTS

Hereinafter, an embodiment of a jet injection device according to the present disclosure will be described with reference to the accompanying drawings.

Figure 1:
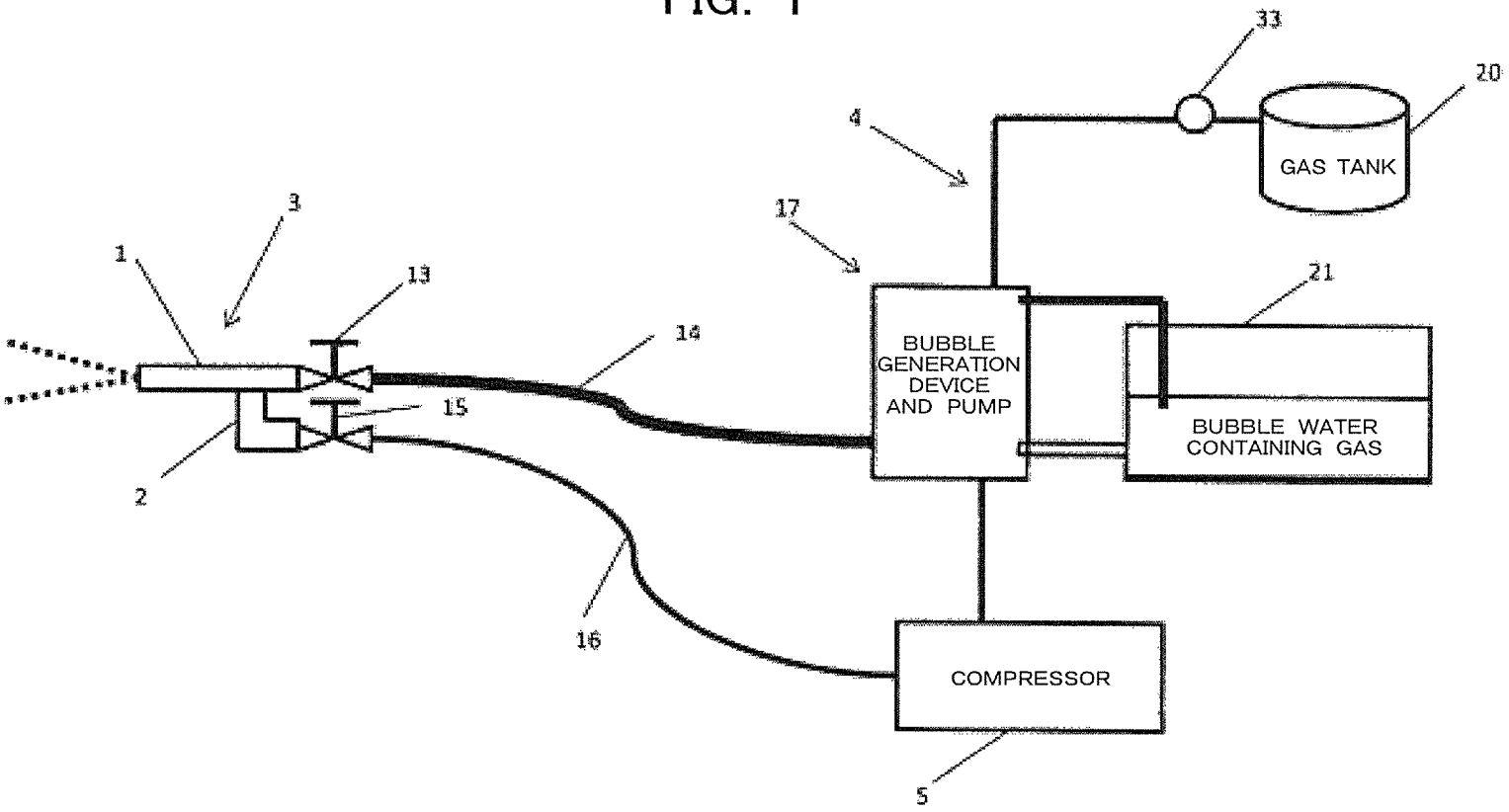
FIG. 1 is a schematic explanatory view of a jet injection device of the present disclosure.

As illustrated in a schematic explanatory view of FIG. 1, the jet injection device of the present disclosure includes: a two-fluid nozzle 3 including a nozzle outer cylinder 1 of a cylindrical pipe and an air connection pipe 2 integrally connected to the nozzle outer cylinder 1 at a right angle; a nanobubble generation device 4 configured to supply high-pressure nanobubble water to the nozzle outer cylinder 1 of the two-fluid nozzle 3 on one side thereof; and a compressor 5 configured to supply high-pressure air to the air connection pipe 2 of the two-fluid nozzle 3 on the other side thereof.

Figure 2:
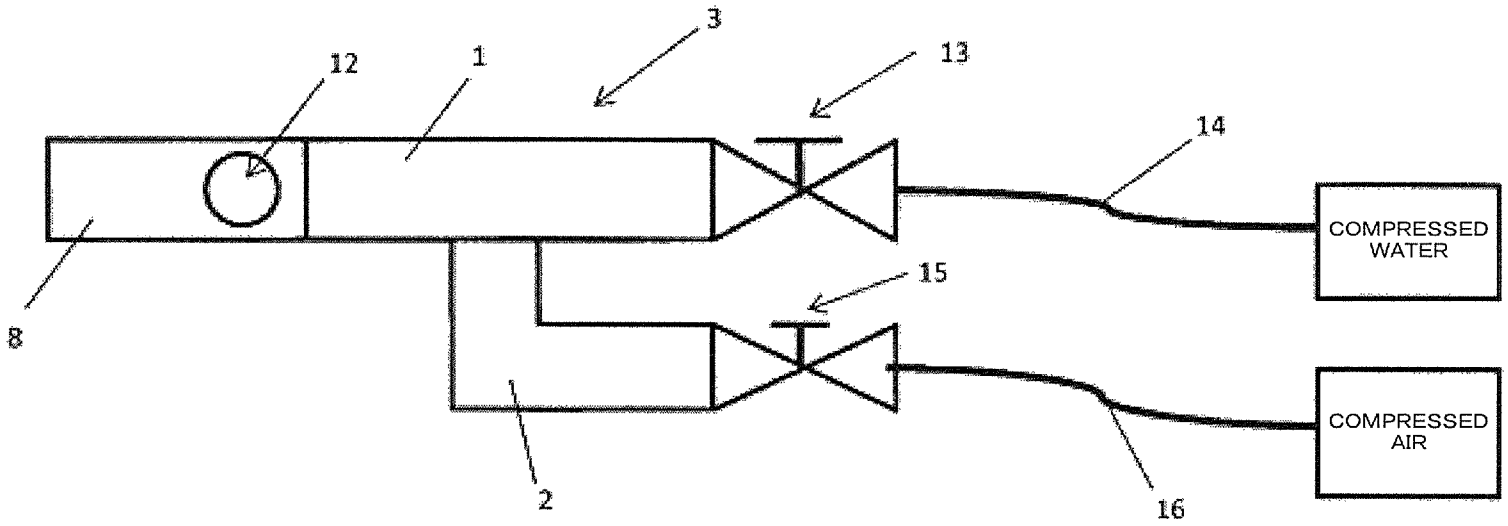
FIG. 2 is an explanatory view of a two-fluid nozzle of the jet injection device.
Figure 3:
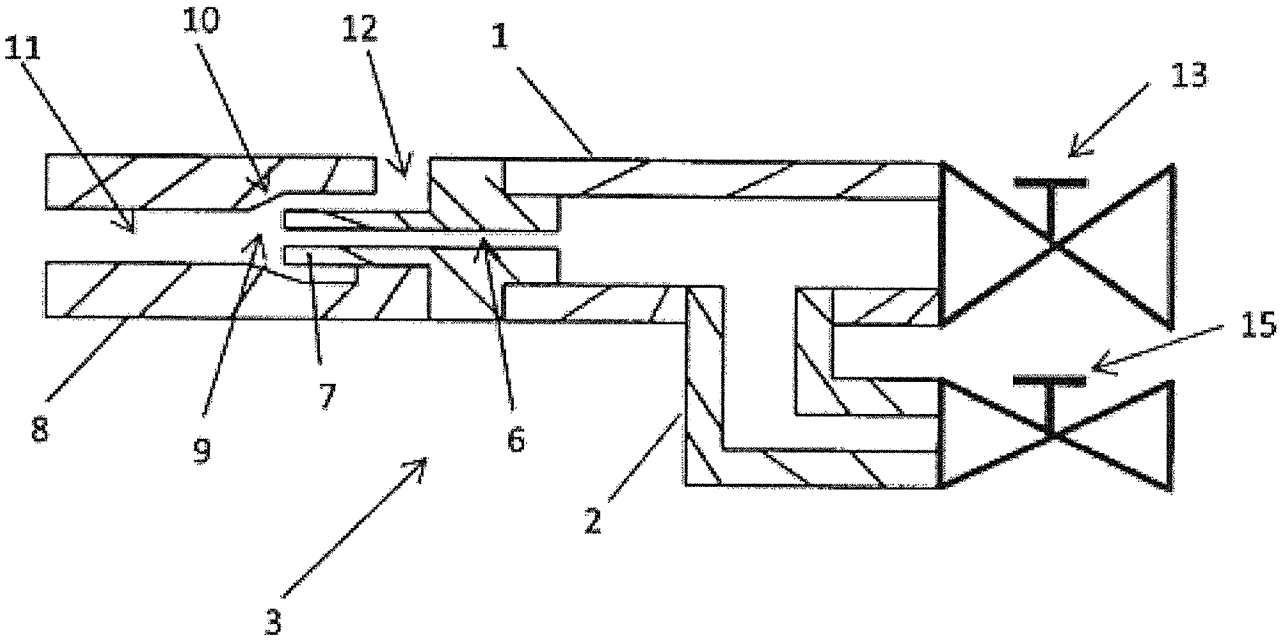
FIG. 3 is a cross-sectional view of the two-fluid nozzle of the jet injection device.

As illustrated in an explanatory view of FIG. 2 and a cross-sectional view of FIG. 3, the two-fluid nozzle 3 is provided with the nozzle outer cylinder 1 of a cylindrical pipe made of metal or a synthetic resin, and the air connection pipe 2 is integrally joined to the nozzle outer cylinder 1 at a right angle.

In addition, the nozzle outer cylinder 1 includes: a nozzle beak 7 which is connected to a downstream-side tip portion thereof and has a small diameter through-hole 6 formed therein; and a nozzle cylinder 8 which is connected thereto so as to surround the nozzle beak 7.

The nozzle cylinder 8 includes: a nozzle chamber 9 having a large diameter to house the nozzle beak 7; a tapered surface 10 which is formed therein so as to have a reduced diameter inward from the nozzle chamber 9; and a large diameter through-hole 11 which is formed therein continuously from the tapered surface 10 and has a larger diameter than the small diameter through-hole 6 of the nozzle beak 7. The nozzle beak 7 is disposed in such a way that the tip thereof is close to the tapered surface 10.

The nozzle cylinder 8 has an air suction hole 12 provided in an outer periphery thereof so as to communicate with an outside air in the nozzle chamber 9 of the nozzle cylinder 8.

Further, the nozzle outer cylinder 1 is connected with high-pressure fluid pipe 14 at an upstream-side tip portion thereof through a first valve 13, to which compressed water, namely, the high-pressure nanobubble water in the present embodiment is supplied.

The air connection pipe 2 is connected with high-pressure air pipe 16 through a second valve 15, to which compressed air is supplied.

In the gas phase/liquid phase two-fluid nozzle 3, a pressure of the liquid is recovered by an air pressure, and a density difference between the air and the liquid occurs to be guided to the nozzle beak 7. In the nozzle beak 7, a negative pressure corresponding to a flow rate is generated by the Bernoulli's theorem. Due to the negative pressure, particles having a particle diameter of mist in a range of 10 μm to 150 μmare generated. The mist has an average particle diameter of 50 μm.

Since the particle diameter of the mist may be varied according to an amount of the compressed air, a desired particle diameter can be obtained by the variation of the second valve 15 at hand.

The large diameter through-hole 11 of the nozzle cylinder 8 used herein has a diameter of 4 mm or more, but a larger bore diameter than the above range may also be used according to a pumping capability.

The flying distance of the mist is 12 m to 15 m at a ground height of 1 m in an air pressure of 0.7 MPa with a liquid pressure of 3 $kgf/cm^2$.

The nanobubble particles are blown into the mist by mixing the same, but by feeding gases in the nanobubbles, it is possible to obtain the effect by colliding the nanobubbles with an object without evaporation on the way. Only with the mist, an evaporation speed is fast and the effect is limited in a particle diameter of 20 μm or less. However, the efficacy of stable mist can be expected for a long time since the mist containing nanobubbles is hard to evaporate.

Figure 4:
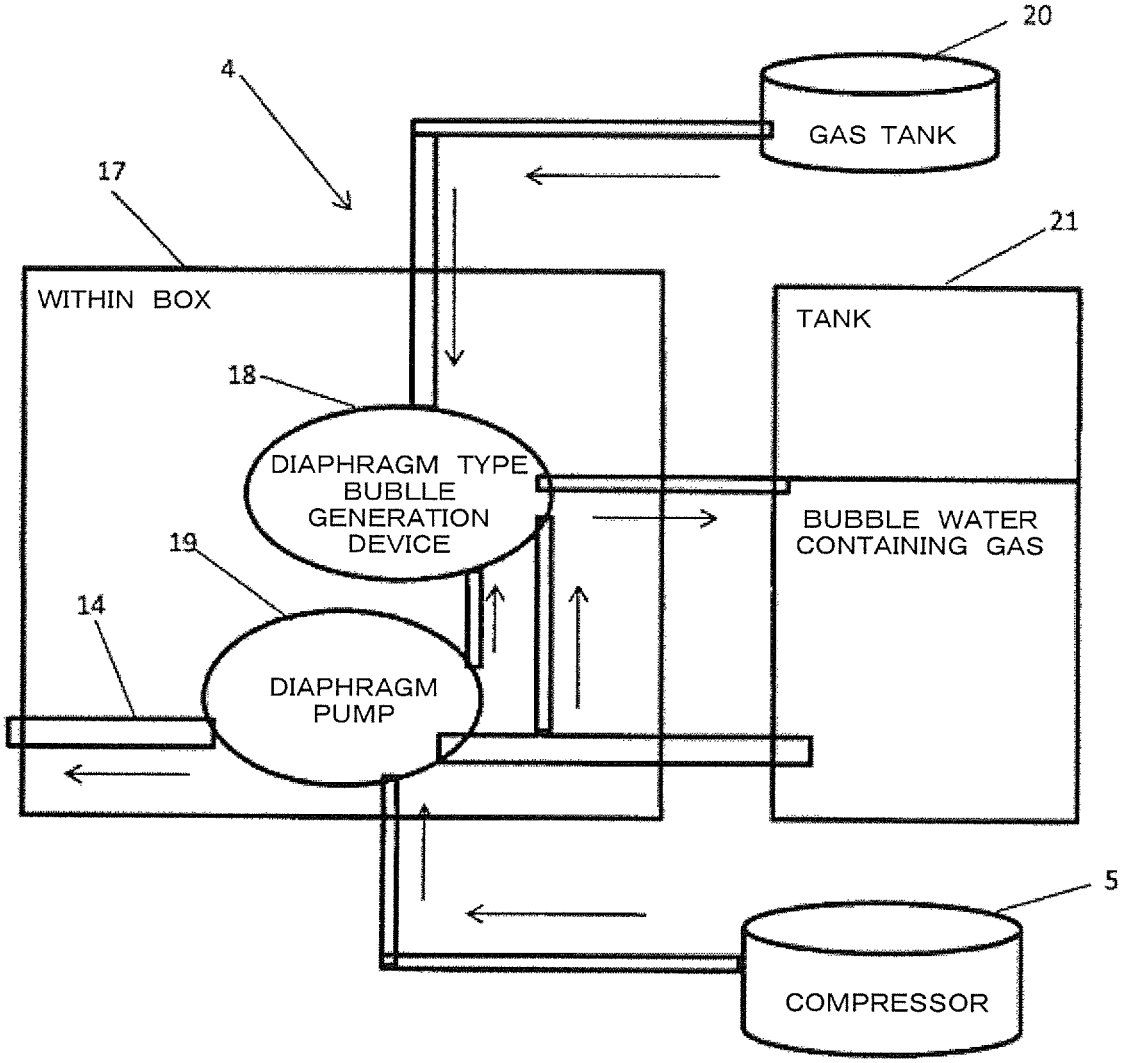
FIG. 4 is a schematic explanatory view of a nanobubble generation device for generating nanobubbles containing various gases.

As illustrated in a schematic explanatory view of FIG. 4, the nanobubble generation device 4 includes a diaphragm type bubble generation device 18 and a diaphragm pump 19, which are installed in a box 17.

The diaphragm type bubble generation device 18 is connected with a gas tank 20 for feeding various gases such as $CO_2$ and a water storage tank 21 for storing water, and nanobubble foams generated by the diaphragm type bubble generation device 18 are stored in the water storage tank 21. The number of particles of the nanobubble generated by the diaphragm type bubble generation device 18 is $1.5\times10^8$ per 1 ml. Furthermore, the nanobubble foams containing various gases are preserved for a long time in the water storage tank 21, and do not disappear immediately.

In the diaphragm pump 19, bubble water containing various gases in the water storage tank 21 is drawn through one side thereof, and the compressed air from the compressor 5 is introduced through the other side thereof.

The bubble water containing various gases and the compressed air are brought into a gas-liquid mixed state by the diaphragm pump 19, and the nanobubble water that has a high pressure is sent to high-pressure liquid pipe 14 on the downstream side.

Figure 5:
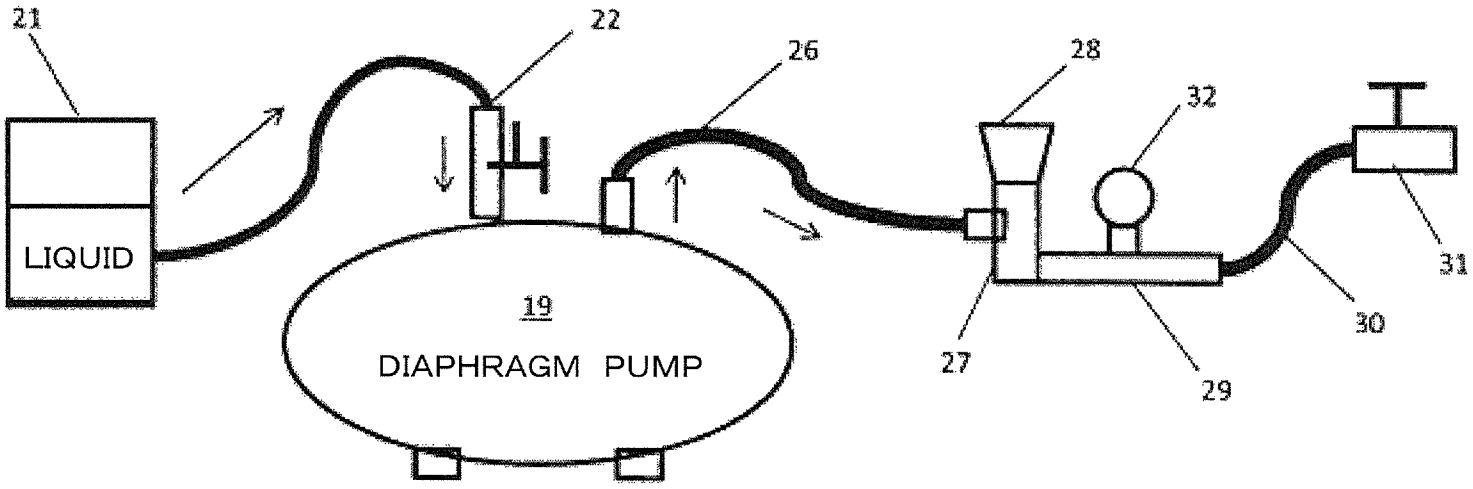
FIG. 5 is a principle explanatory view of the nanobubble generation device.
Figure 6:
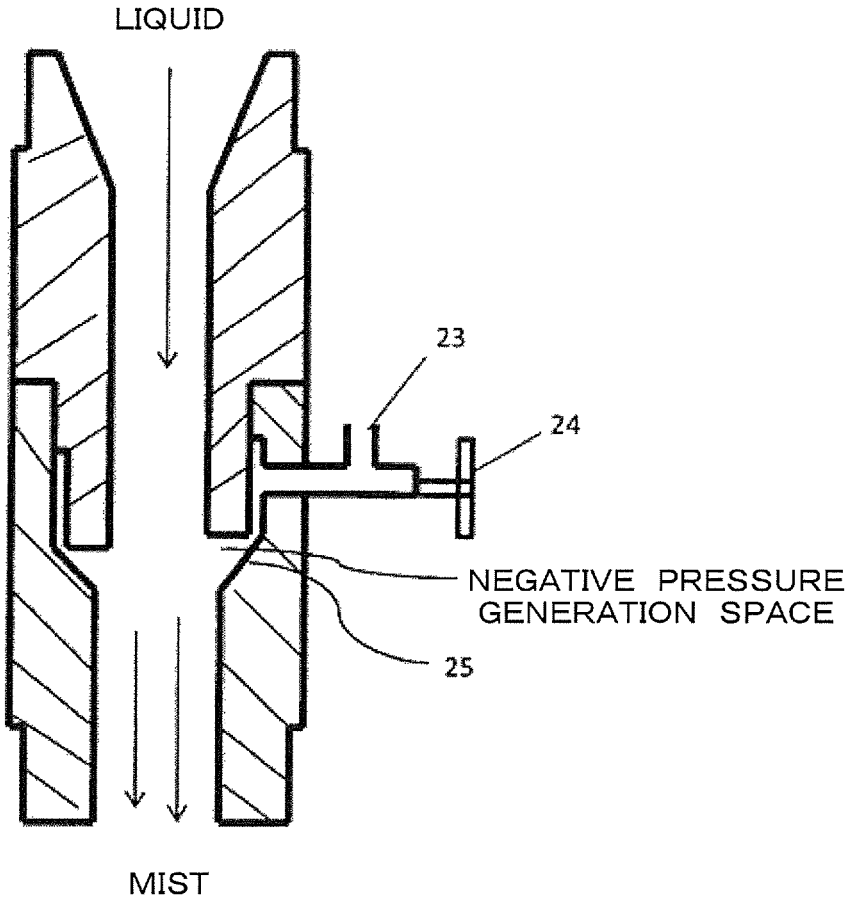
FIG. 6 is a cross-sectional view of the two-fluid nozzle of the nanobubble generation device.

As illustrated in a principle explanatory view of FIG. 5, the nanobubble generation device 4 pumps the liquid in the water storage tank 21 to a two-fluid nozzle 22. In the two-fluid nozzle 22, as illustrated in a cross-sectional view of FIG. 6, high-pressure gas is sent from a various-gas suction port 23 through a gas valve 24, and high-pressure liquid and the high-pressure gas are mixed by the negative pressure generated in a negative pressure generation space of a tapered surface 25 due to the flow rate of the high-pressure liquid indicated by one arrow, and are sent to the downstream as a mist swirling flow in the gas-liquid mixed state.

The high-pressure liquid and gas are intermittently brought into the high-pressure gas-liquid mixed fluid by the diaphragm pump 19 illustrated in FIG. 5 to be sent to a flexible pipe 26. The gas-liquid mixed fluid is returned to a steady state in the flexible pipe 26 to be in a supersaturated state, such that cavitation (a phenomenon in which bubbles are formed and collapse) is strongly generated, thus to deposit the dissolved gases. At this time, the gas-liquid mixed fluid boils.

The gas-liquid mixed fluid is sent as it is and is guided so as to have an appropriate clearance by an air vent valve 28 of a vertical T-shaped joint 27, and is returned to a normal pressure, thus to bring the gases dissolved in the liquid into nanobubbles to be guided into the water storage tank 21 through a horizontal type T-shaped joint 29, a tube 30, and a pressure reducing valve 31.

Furthermore, the horizontal T-shaped joint 29 is connected with a pressure meter 32 for measuring a pressure.

Next, an operation of the jet injection device according to the present disclosure will be described below with reference to the accompanying drawings.

As illustrated in FIG. 1, the high-pressure gas, for example, $CO_2$ gas in the gas tank 20 is pumped to the diaphragm type bubble generation device 18 illustrated in FIG. 4 through a regulator 33, while the water stored in the water storage tank 21 is pumped to the diaphragm type bubble generation device 18 similarly thereto.

In the diaphragm type bubble generation device 18, nanobubble water is generated according to the principle illustrated in FIG. 5, and $CO_2$ nanobubble water is stored in the water storage tank 21.

The $CO_2$ bubble water and the compressed air are brought into a gas-liquid mixed state by the diaphragm pump 19, and the nanobubble water that has a high pressure is sent to the high-pressure liquid pipe 14 on the downstream side.

The compressed water, that is, the nanobubble water is pumped from the high-pressure liquid pipe 14 through the first valve 13 to the two-fluid nozzle 3 illustrated in FIG. 1, as well as the compressed air is sent by the compressor 5 from the high-pressure air pipe 16 through the second valve 15.

Since the nanobubble water is pumped to the nozzle outer cylinder 1 of a straight pipe illustrated in FIG. 3 and the compressed air is simultaneously pumped from the air connection pipe 2, gas-liquid mixing occurs at a meeting point thereof to bring into a gas-liquid mixed fluid, and then be flown to the nozzle beak 7.

Since the nozzle beak 7 is disposed close to the tapered surface 10 in the nozzle chamber 9, a negative pressure is generated at the tip of the nozzle beak 7, and the outside air is introduced through the air suction hole 12. Herein, the outside air and the gas-liquid mixed fluid are met with each other, and are sent to the downstream as a mist swirling flow in the gas-liquid mixed state, and then are injected at a high speed as a mist containing nanobubbles from a tip portion of the nozzle cylinder 8.

The present disclosure has the greatest characteristic of incorporating the nanobubble particles in the mist to be sprayed, thereby different effects can be exerted depending on a type of the gas incorporated in the mist.

When only the mist has a particle diameter of 10 μm or less, it may evaporate in the atmosphere. However, by incorporating the nanobubbles in the mist, it is difficult to evaporate, and by negatively and strongly charging, a negative charging effect and incorporating effect may be obtained for an object to be injected to enhance efficacy upon reaching a destination.

In the agricultural field, it has been confirmed that bacteriostatic and antibacterial effects may be obtained for germs, bacteria and the like when spraying the mist containing nanobubbles containing $CO_2$ gas. In addition, the mist containing nanobubbles containing $CO_2$ gas also helps a photosynthetic effect of plants during the day, such that it may be expected to enhance storing solar energy (starch production).

A danger of gas poisoning to humans or animals is also known to be a risk when using a conventional raw gas seal within a cultivation greenhouse, but sealing and spraying the gas in the mist of the present disclosure are performed in a form that the mist can be seen, such that there is little danger of exceeding dangerous gas concentrations.

For plants, it is convenient since nanobubble hydration contributes to absorption in both of leaves and roots. In that case, applying oxygen water to the roots and $CO_2$ water on the leaves may contribute to the growth of the plants.

By incorporating nanobubble particles in the mist for removing salt damage to an aircraft, the effect of gas and the effect of flowing water, as well as the effect of negatively charging the entire mist may be obtained for the object to be injected. These are effects that cannot be found in a conventional high-pressure washer.

Although there is no device to propel the raw gas to a distance of 10 m or more, the nanobubble mist is convenient since it facilitates the raw gas to be easily flown in the mist.

The nanobubbles contained in the mist are changed due to a sufficiently high pressure, and may not be broken by the pressure inside the device.

Since the nanobubbles once produced may be maintained for several months, it is possible to produce and store the nanobubbles in advance, and it is convenient since the nanobubbles may be used by making them in advance in a tank.

As described above, the jet injection device of the present disclosure may be used for many purposes, but may also be used for the following applications.

1. Cleaning device

Use of the liquid as a cleaning agent in a cleaning device may become about half of that used in a conventional high-pressure washer.

Since the nozzle has a release type tip (without diaphragm), there is no clogging or the like.

The flow rate of the mist is Mach 1 at the tip of the nozzle, and a mist group may be sprayed to the object without scattering. Since the mass of water is not flown but each grain is flown while having a complete particle diameter, a cleaning effect is high.

2. Fire extinguishing equipment $CO_2$ gas may be sprayed to a destination, such that an effect of blocking other gas may be expected.

3. Propeller of a ship

When using as a propeller, high output propulsion may be obtained due to a reaction effect.

4. Bubble bath

The invention claimed is:

1. A jet injection device comprising:

a two-fluid nozzle including a nozzle outer cylinder of a cylindrical pipe and an air connection pipe integrally connected to the nozzle outer cylinder at a right angle;

a nanobubble generation device configured to supply high-pressure nanobubble water to the nozzle outer cylinder of the two-fluid nozzle on one side thereof; and a compressor configured to supply high-pressure air to the air connection pipe of the two-fluid nozzle on the other side thereof.

2. The jet injection device according to claim 1, wherein the two-fluid nozzle is characterized in that:

the nozzle outer cylinder includes a nozzle beak which is connected to a downstream-side tip portion thereof and has a small diameter through-hole formed therein, and a nozzle cylinder which is connected thereto so as to surround the nozzle beak;

the nozzle cylinder includes a nozzle chamber having a large diameter to house the nozzle beak, a tapered surface which is formed therein so as to have a reduced diameter inward from the nozzle chamber, and a large diameter through-hole which is formed therein continuously from the tapered surface and has a larger diameter than the small diameter through-hole of the nozzle beak;

the nozzle beak is disposed in such a way that the tip thereof is close to the tapered surface; and the nozzle cylinder has an air suction hole provided in an outer periphery thereof so as to communicate with an outside air in the nozzle chamber of the nozzle cylinder.

3. The jet injection device according to claim 1, wherein the nanobubble generation device includes a diaphragm type bubble generation device and a diaphragm pump, the diaphragm type bubble generation device is connected with a gas tank for feeding $CO_2$ gas and a water storage tank for storing water, and nanobubble foams generated by the diaphragm type bubble generation device are stored in the water storage tank, in the diaphragm pump, bubble water containing various gases in the water storage tank is drawn through one side thereof, and compressed air from the compressor is introduced through the other side thereof, and the bubble water containing various gases and the compressed air are brought into a gas-liquid mixed state by the diaphragm pump, and the nanobubble water that has a high pressure is sent to a high-pressure liquid pipe on a downstream side.

* * * * *